US006359187B1

(12) United States Patent
Lamoureux

(10) Patent No.: US 6,359,187 B1
(45) Date of Patent: Mar. 19, 2002

(54) METHOD OF SEALING CONTAINER FOR HANDLING RADIOACTIVE DEBRIS

(75) Inventor: Edward F. Lamoureux, Hampden, MA (US)

(73) Assignee: Westinghouse Electric Company LLC, Pittsburgh, PA (US)

( * ) Notice: Subject to any disclaimer, the term of this patent is extended or adjusted under 35 U.S.C. 154(b) by 0 days.

(21) Appl. No.: 09/265,825

(22) Filed: Mar. 10, 1999

Related U.S. Application Data

(60) Provisional application No. 60/093,795, filed on Jul. 23, 1998.

(51) Int. Cl.[7] ..... G21F 9/22

(52) U.S. Cl. ..... 588/20; 588/249; 588/260

(58) Field of Search ..... 588/16, 20, 90, 588/249, 260; 210/416.1, 512.1, 499, DIG. 9, 138, 188, 195.1, 19.6, 253, 258, 259, 323.2, 407, 413, 513, 538, 539, 167

(56) References Cited

U.S. PATENT DOCUMENTS 4,983,282 A * 1/1991 Roy et al. ..... 210/95
5,022,995 A * 6/1991 Roy et al. ..... 210/651
5,143,615 A * 9/1992 Roy et al. ..... 210/350
5,227,060 A * 7/1993 Roy et al.

* cited by examiner

*Primary Examiner*—Steven P. Griffin
*Assistant Examiner*—Eileen E. Nave

(57) ABSTRACT

A system and method for filling, dewatering and sealing high integrity containers for storing high level radioactive debris has a support structure for receiving a container and a movable hood supported over the support structure. The movable hood is movable between a filling/dewatering position, an intermediate position, and a sealing position. Fill and dewatering lines extend through the hood and have flexible lower portions with connectors for interfacing with the container to be filled. The flexible lower portions are movable into and out of engagement with respective connectors on the container when the hood is in the filling/dewatering position. A plurality of valves are provided to isolate the fill and dewatering lines to minimize release of radioactive debris during connector mating and demating operations. A straw extends through the hood for removing water from an upper volume of the container when the hood is in the intermediate position. A closing structure is supported by the hood for lowering a cover into engagement with the container and fastening the cover to the container when the hood is in the sealing position. A vent line is provided for purging gas from the hood. A vibrator is positioned within the support structure for engaging and vibrating the container to facilitate filling and dewatering operations. A scale is positioned between the container and the support structure for determining when the container is full.

7 Claims, 5 Drawing Sheets

METHOD OF SEALING CONTAINER FOR HANDLING RADIOACTIVE DEBRIS

RELATED APPLICATIONS

This application claims the benefit of U.S. Provisional Application Serial No. 60/093,795 filed on Jul. 23, 1998. The subject matter of this application is related to the Applicant's copending applications titled "Filtration System for Concentrating Radioactive Debris," "Container for Handling and Storing Radioactive Debris," and "Magnetic Filtration System for Mining Radioactive Waste During Abrasive Waterjet Cutting", Ser. No. 09/265,823 filed Mar. 10, 1999, Ser. No. 09/265,826 filed Mar. 10, 1999 and Ser. No. 09/265,824 filed Mar. 10, 1999, respectively), all of which are being filed concurrently with the present application and are incorporated herein by reference.

BACKGROUND OF THE INVENTION

1. Field of the Invention

The present invention relates generally to the stabilization, handling, transport, and storage of small radioactive particles removed from a volume of water. In particular, the present invention relates to a system and method of filling, dewatering, sealing and handling high integrity containers for storing high level radioactive debris filtered from a volume of water for disposal.

2. Description of the Related Art

Commercial nuclear reactor power plants have various water volumes that are subject to contamination with radioactive debris particulate. These water volumes include, for example, the refueling cavity and the spent fuel pool. The particulate contained in these water volumes typically includes "crud" (corrosion products) and "cutting fines" that may range in size from sub-micron to several millimeters in cross-section. The cutting fines are often mixed with other non-radioactive particles that are byproducts of a cutting operation, such as abrasive or electrode materials.

There are several reasons that the radioactive debris particulate needs to be removed from the various water volumes in the nuclear reactor power plants from time-to-time. For example, the small particles often must be removed from the water for disposal, to improve water clarity, and/or to reduce the radiation level of the water volume. Once the small radioactive particles are removed from the water using a suitable filtration system, the particles must be placed in containers that allow safe handling, transport and storage of the particles.

Small, highly radioactive debris particulate, such as that generated during the dismantling of reactor internals, is considered unstable unless it is captured in high integrity containers. Conventional systems for containing the debris particulate mix or encapsulate the debris particulate with or within other materials to stabilize the material. However, the particulate stabilized in this manner is difficult to retrieve for future processing. Other conventional systems lack sufficient seals and redundancy to assure that there is no possibility of small particles migrating from the container into the water pool or other storage facility. These conventional systems also lack an integral dewatering filter, thereby making them more difficult to use and increasing the amount of secondary waste and radiation dose to operating personnel.

Vendors performing dismantling operations in the commercial nuclear power decommissioning business have experienced significant problems with refueling cavity contamination, increased costs for disposal of waste, and dose rates to personnel that are not As Low As is Reasonably Achievable ("ALARA"). These problems have been partly due to the lack of a system for filling, sealing and handling high integrity containers for storing the concentrated radioactive particles removed from the various water volumes in the nuclear power plant.

SUMMARY OF THE INVENTION

It is an object of the present invention to provide an improved system and method of filling, sealing and handling high integrity containers for storing radioactive debris that solves the problems associated with the prior art.

It is a further object of the present invention to provide an improved system and method of remotely filling, dewatering, sealing and handling high integrity containers underwater for storing radioactive debris to minimize radiation exposure to operating personnel.

It is a further object of the present invention to provide a system and method of filling and dewatering high integrity containers using a vibration source to assist flow through an internal filter during a dewatering process.

It is a still further object of the present invention to provide a system for filling, sealing and handling high integrity containers using a plurality of valves for isolating fill and dewatering lines to assure minimal release of particulate during connector mating and demating operations.

According to the present invention, an improved system is provided for filling, dewatering and sealing high integrity containers for storing high level radioactive debris. The system has a support structure for receiving a container and a movable hood supported over the support structure. The movable hood is movable between a filling/dewatering position, an intermediate position, and a sealing position. Fill and dewatering lines extend through the hood and have flexible lower portions with connectors for interfacing with the container to be filled. The flexible lower portions are movable into and out of engagement with respective connectors on the container when the hood is in the filling/dewatering position. A plurality of valves are provided to isolate the fill and dewatering lines to minimize release of radioactive debris during connector mating and demating operations. A straw extends through the hood for removing water from an upper volume of the container when the hood is in the intermediate position. A closing structure is supported by the hood for lowering a cover into engagement with the container and fastening the cover to the container when the hood is in the sealing position. A vent line is provided for purging gas from the hood. A vibrator is positioned within the support structure for engaging and vibrating the container to facilitate filling and dewatering operations. A scale is positioned between the container and the support structure for determining when the container is full.

According to another broad aspect of the present invention, a combination of a container for storing radioactive debris and a system for filling and sealing the container is provided. The container comprises an enclosure having a primary volume for receiving and containing radioactive debris; a fill tube in fluid communication with said primary volume for injecting radioactive debris into said primary volume; a dewatering filter having a filtering surface exposed to a space for containing radioactive debris within said primary volume; and a dewatering tube in fluid communication with said dewatering filter for extracting water from said container that passes through said dewatering filter. The system for filling and sealing the container comprises a support structure having a space into which said container is received; a hood supported over said support structure, said hood being movable relative to said support structure between a filling/dewatering position and a sealing position; a fill line supported by said hood for injecting radioactive debris into said container when said hood is in said filling/dewatering position, said fill line being movable into fluid communication with said fill tube of said container; a dewatering line supported by said hood for removing water from said primary volume of the container when said hood is in said filling/dewatering position, said dewatering line being movable into fluid communication with said dewatering tube of said container; and a closing structure supported by said hood for securing a cover over the container when said hood is in said sealing position.

According to another broad aspect of the present invention, a method of filling and sealing a container with radioactive debris is provided. The method comprises the steps of: placing a container within a support structure submerged in water and covering the support structure and container with a hood submerged in the water; lowering a connector portion of a fill line into a secondary volume of the container and connecting the connector portion of the fill line to a fill tube of the container; lowering a connector portion of a dewatering line into the secondary volume of the container and connecting the connector portion of the dewatering line to a dewatering tube of the container; injecting a slurry of radioactive debris into a primary volume of the container through the fill line and fill tube; and removing fluid from the slurry of radioactive debris within the container through the dewatering tube and dewatering line.

The method according to this aspect of the present invention may also include the further steps of: vibrating the container to facilitate the removal of water from the radioactive slurry; monitoring an amount of radioactive debris within the container using a scale positioned between the support structure and the container; isolating the fill line and fill tube using a first pair of valve assemblies; isolating the dewatering line and dewatering tube using a second pair of valve assemblies; raising the respective connector portions of the fill line and dewatering line out of the secondary volume of the container; moving the hood relative to the support structure and container into an intermediate position; introducing a gas into the hood to displace water within the hood to a level below an upper end of the container; lowering a straw into the secondary volume of the container and removing water from the secondary volume through the straw; visually checking a water level in the secondary volume using a camera; raising the straw out of the secondary volume; moving the hood relative to the support structure and container into a sealing position; lowering a cover into sealing engagement with the container; and securing the cover to the container.

Numerous other objects of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

A system and method of filling, dewatering, and sealing high integrity containers for handling and storing radioactive debris according to the present invention will now be described with reference to FIGS. 1 to 8 of the accompanying drawings.

Figure 1:
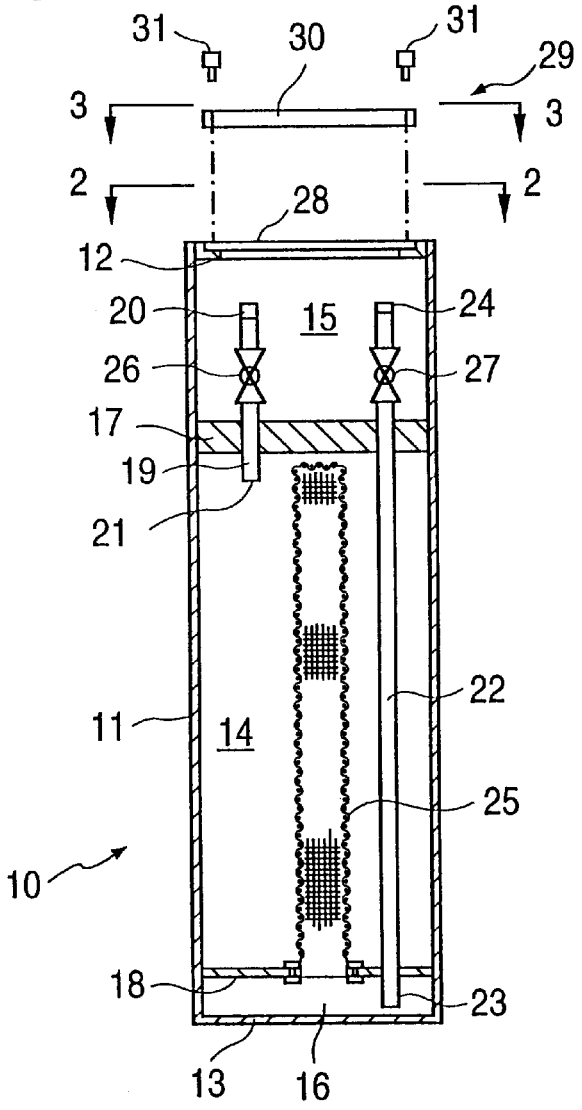
FIG. 1 is an elevation section view of a container for handling and storing radioactive debris.
Figure 2:
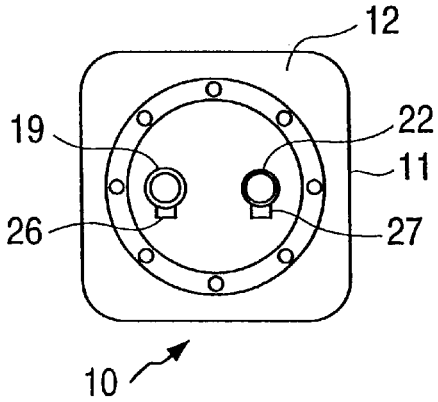
FIG. 2 is a plan view of the container shown in FIG. 1, as viewed along line 2—2 in FIG. 1.
Figure 3:
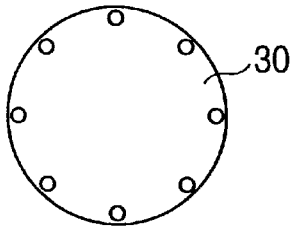
FIG. 3 is a plan view of a cover for the container shown in FIG. 1, as viewed along line 3—3 in FIG. 1.
Figure 4:
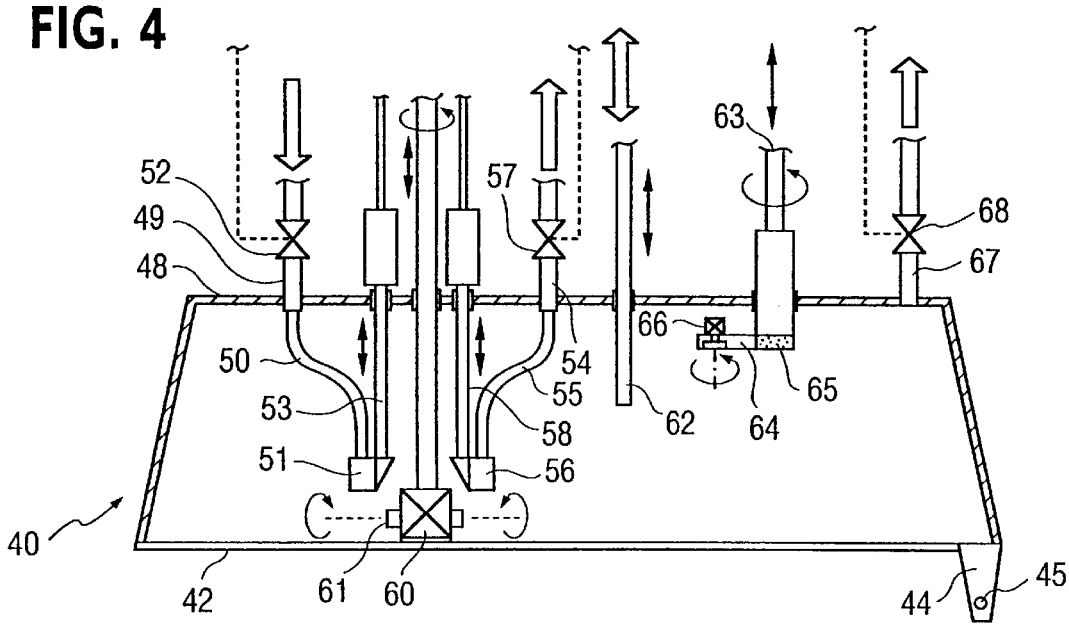
FIG. 4 is an elevation view of a hood assembly of the present invention.

The high integrity container 10 shown in FIGS. 1 to 3 comprises a container enclosure defined by an outer shell 11, and top and bottom plates 12, 13 secured to upper and lower ends of the outer shell 11, respectively. Within the enclosure is a first enclosed portion 14 defining a space for receiving and containing radioactive debris, a second enclosed portion 15 adjacent to an upper end of the first enclosed portion 14, and a third enclosed portion 16 adjacent to a lower end of the first enclosed portion 14. The first enclosed portion will be referred to herein as a primary volume 14 of the container 10, the second enclosed portion will be referred to as a secondary volume 15, and the third enclosed portion will be referred to as a water collection chamber 16.

A first connection support 17 is mounted within the enclosure below the top plate 12 to separate the primary volume 14 from the secondary volume 15. A second connection support 18 is mounted within the enclosure above the bottom plate 13 to separate the primary volume 14 from the water collection chamber 16.

A fill tube 19 extends through an opening in the first connection support 17 and has an inlet end 20 located within the secondary volume 15, and an outlet end 21 open to the primary volume 14. A dewatering tube 22 extends from the water collection chamber 16 to the secondary volume 15 through openings in the first and second connection supports 17, 18, respectively. The dewatering tube 22 has an inlet end 23 located within the water collection chamber 16, and an outlet end 24 located within the secondary volume 15.

A dewatering filter 25 extends upwardly from the second connection support 18 through a substantial length of the primary volume 14. The dewatering filter 25 has a filtering surface exposed to the radioactive debris over a large surface area within the primary volume 14 to facilitate dewatering. The filter 25 is in fluid communication with the water collection chamber 16 such that water passing through the filtering surface and into the filter 25 drains into the water collection chamber 16. The dewatering tube 22 is in fluid communication with the water collection chamber 16 for extracting water that accumulates in the water collection chamber 16 from the dewatering filter 25. The dewatering filter 25 can be of either nonmetallic (for non-GTCC waste) or metallic (for GTCC waste) construction and have a micron size rating selected for the specific filtering requirements (the acronym "GTCC" refers to Greater Than Class "C" waste as defined by 10 CFR Part 61).

The inlet end 20 of the fill tube 19 and the outlet end 24 of the dewatering tube 22 each have respective connecting valve assemblies 26, 27 for connecting the fill tube 19 and dewatering tube 22 to external filling and dewatering equipment (described below). The connecting valve assemblies 26, 27 each have respective ball valves for sealing the primary volume 14 and water collection chamber 16 from the secondary volume 15 when the container 10 is not connected to the external equipment, for example, during transport and storage of the container 10. The ball valves are modified valves that contain only stainless steel parts and are, therefore, suitable for long term storage in a spent fuel pool, Interim Spent Fuel Storage Facility (ISFSF) or ultimate burial.

The top plate 12 has an access port 28 formed therein for accessing the connecting valve assemblies 26, 27 of the fill tube 19 and dewatering tube 22. A cover plate assembly 29 is provided for covering the access port 28 to seal the secondary volume 15 from the outside environment. The cover plate assembly 29 includes a cover plate 30 secured to the top plate 12 using a suitable fastening means 31, such as threaded bolts, screws, clamps, or the like, and a suitable gasket or O-ring (not shown) sandwiched between the cover plate 30 and the top plate 12. The secondary volume 15 is a feature of the container 10 that allows the fill tube 19 and the dewatering tube 22 to be isolated, the valves 26, 27 to be closed and locked, and the fill tube 19 and dewatering tube 22 to be remotely disconnected. Moreover, once the access port 28 is sealed by the cover plate assembly 29, the secondary volume 15 provides a redundant seal to the closed and locked ball valves 26, 27 to complete the closure of the high integrity container 10.

In operation, radioactive debris is injected into the container 10 by connecting the waste sources to the connecting valve assembly 26 of the fill tube 19 and injecting a slurried waste into the primary volume 14. Water in the waste passes through the dewatering filter 25 into the water collection chamber 16. The dewatering tube 22 forms a seal with the first and second connection supports 17, 18 and provides a path for water removed from the radioactive debris to escape from the container 10 through the connection valve assembly 27 of the dewatering tube 22. The water removal process may be aided by pressurizing waste on the fill side and/or applying a partial vacuum on the dewatering side and/or applying a vibratory (mechanical or ultrasonic) source to the container 10. The internal dewatering filter 25 is constructed to withstand the pressure differentials imposed by the dewatering process.

The bottom of the dewatering tube 22 is located a distance above the surface of the bottom plate 13 that will assure less than one percent (1%) of standing water will remain in the container 10 relative to the distance between the inside surfaces of the first and second connection supports 17, 18.

The system for filling, dewatering, and sealing the container 10 according to the present invention will now be described in detail.

The system includes a hood 40 (FIG. 4) and a support structure 41 (FIG. 5) on which the hood 40 is mounted for sliding movement. The hood 40 has one or more guide rails 42 extending along its lower side that interconnect with one or more guide rails 43 extending along an upper side of the support structure 41. The guide rails 42, 43 can be of any structure that permits relative movement between the hood 40 and the support structure 41 to facilitate movement of the hood 40 to a plurality of selected positions relative to a container 10 held in the support structure 41. A flange 44 is secured to the hood 40 and has a pin hole 45 formed therein for connecting to a piston rod end 46 of a hydraulic servomotor 47 mounted to the support structure 41.

A variety of components are secured to and extend through an upper surface 48 of the hood 40. Seals or welds are provided at the interface between these components and the hood 40 to maintain a sealed environment beneath the hood 40. A fill line 49 extends through the hood 40 and has a flexible lower portion 50 extending below the hood 40 with a connector 51 for mating with the fill tube connector end 20 on the container 10. A valve 52 is provided in the fill line 49 above the hood 40 for isolating the lower portion 50 of the fill line 49. A pole operator 53 is provided for moving a lower end of the fill line 49 and its associated connector 51 up and down to connect and disconnect the fill line 49 from the container 10. The pole operator 53 is preferably moved by a piston and cylinder arrangement so that an operator can cause the connector 51 of the fill line 49 to move from a remote location. Alternatively, the pole operator 53 can be constructed for manual operation by extending an upper portion thereof above the water surface to allow operation from a remote position above the water.

A dewatering line 54 extends through the hood 40 and has a flexible lower portion 55 extending below the hood 40 with a connector 56 for mating with the dewatering tube connector end 24 on the container 1. A valve 57 is provided in the dewatering line 54 above the hood 40 for isolating the lower portion 55 of the dewatering line 54. A pole operator 58 is provided for moving a lower end of the dewatering line 54 and its associated connector 56 up and down to connect and disconnect the dewatering line 54 from the container 10. The structure of the pole operator 58 is similar to the pole operator 53 associated with the fill line 49.

A valve operator 59 extends through the hood 40 and has a motor 60 and interfacing structure 61 mounted at its lower end. The interfacing structure 61 is made to interface with the isolation ball valves 26, 27 associated with the fill and dewatering lines 19, 22 of the container 10. The valve operator 59 can be moved up and down and rotated to position the motor 60 and interfacing structure 61 relative to the isolation ball valves 26, 27. The motor 60 can be actuated to cause the interfacing structure 61 to selectively close and open the isolation ball valves 26, 27 of the container 10. The lower portions 50, 55 of the fill and dewatering lines 49, 54, the pole operators 53, 58, and the valve operator 59 can all be raised above a container 10 held in the support structure 41 to permit the hood 40 and its associated components to be moved relative to the container 10.

A straw 62 extends through the hood 40 and can be raised and lowered from a remote location. The straw 62 is selectively connected at its upper end to a source of gas (e.g., air or nitrogen) under pressure and to a drain or vacuum pump for suctioning fluids through the straw 62. The straw 62 is used to introduce gas under pressure into the hood 40 to displace water to a level below the top of the container 10. The lower end of the straw 62 is then positioned in the secondary volume 15 of the container 10 and used to suction water out from the secondary volume 15. Once Water has been displaced to a level below the top of the container 10, the pressure within the hood 40 will facilitate the suctioning of water from the secondary volume 15. A suction pump can be connected to the straw 62 to aid in the removal of water from the secondary volume 15.

A closure operator 63 extends through the hood 40 and has a closing structure 64 at its lower end for holding, lowering, and attaching the cover 30 to the container 10. The closing structure 64 includes a suitable holding means, such as a magnet 65, for holding the cover 30 and manipulating the cover 30 into position on the container 10. The closing structure 64 also includes a suitable tightening means, such as a motor-driven socket 66, for tightening each fastening bolt 31 or other structure to secure the cover 30 to the container 10. The closure operator 63 can be raised, lowered, and rotated from a remote location to manipulate and fasten the cover 30 to the container 10.

A vent line 67 extends through the hood 40 and has a valve 68 for purging gas from beneath the hood 40. The vent line 67 is connected to a suitable gas handling system to vent and filter any off-gassing that may occur within the hood 40, particularly during the mating and demating of the connectors 51, 56 to the container 10.

Figure 5:
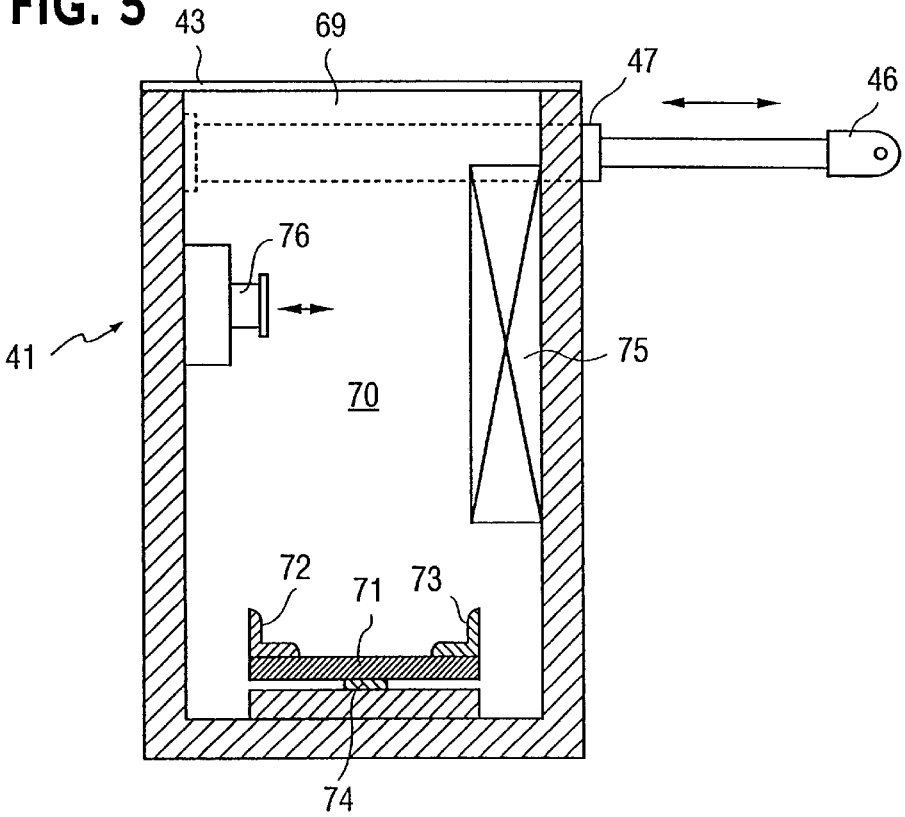
FIG. 5 is an elevation view of a support structure of the present invention.

The support structure 41 shown in FIG. 5 includes a hydraulic servomotor 47 having a piston rod end 46 with a structure for connecting to the mounting flange 44 of the hood 40. The hydraulic servomotor 47 has a stroke length sufficient to move the hood 40 to each of its respective positions relative to the support structure 41. Other suitable actuating means, such as a motor-driven rack and pinion assembly, can be used instead of the hydraulic servomotor 47.

The support structure 41 has an open upper end 69 and a space 70 for accommodating a storage container 10 to be filled with radioactive debris. The container 10 is placed within the support structure 41 through the open upper end 69 before the hood 40 is secured to the support structure 41. Alternatively, the support structure 41 can be provided with a side door or the like which permits the container 10 to be placed within the space 70 while the hood 40 is attached to the support structure 41.

A base holder 71 is provided at the bottom of the support structure 41 and includes flanges 72, 73 for centering the container 10 within the support structure 41. A scale 74 or load cell is provided under the base holder 71 for monitoring the weight of the container 10 as it is being filled. The scale 74 provides an indication of when the container 10 is full and ready for subsequent dewatering and sealing operations.

A mechanical or ultrasonic vibrator 75 is provided on one side of the support structure 41 and held in intimate contact with a side of the container 10. A clamp mechanism, such as a hydraulic actuator 76, is provided on the other side of the container 10 for pushing and holding the container 10 against the vibrator 75. The vibrator 75 can be used to assist the dewatering process and compact the debris within the container 10.

Figure 7:
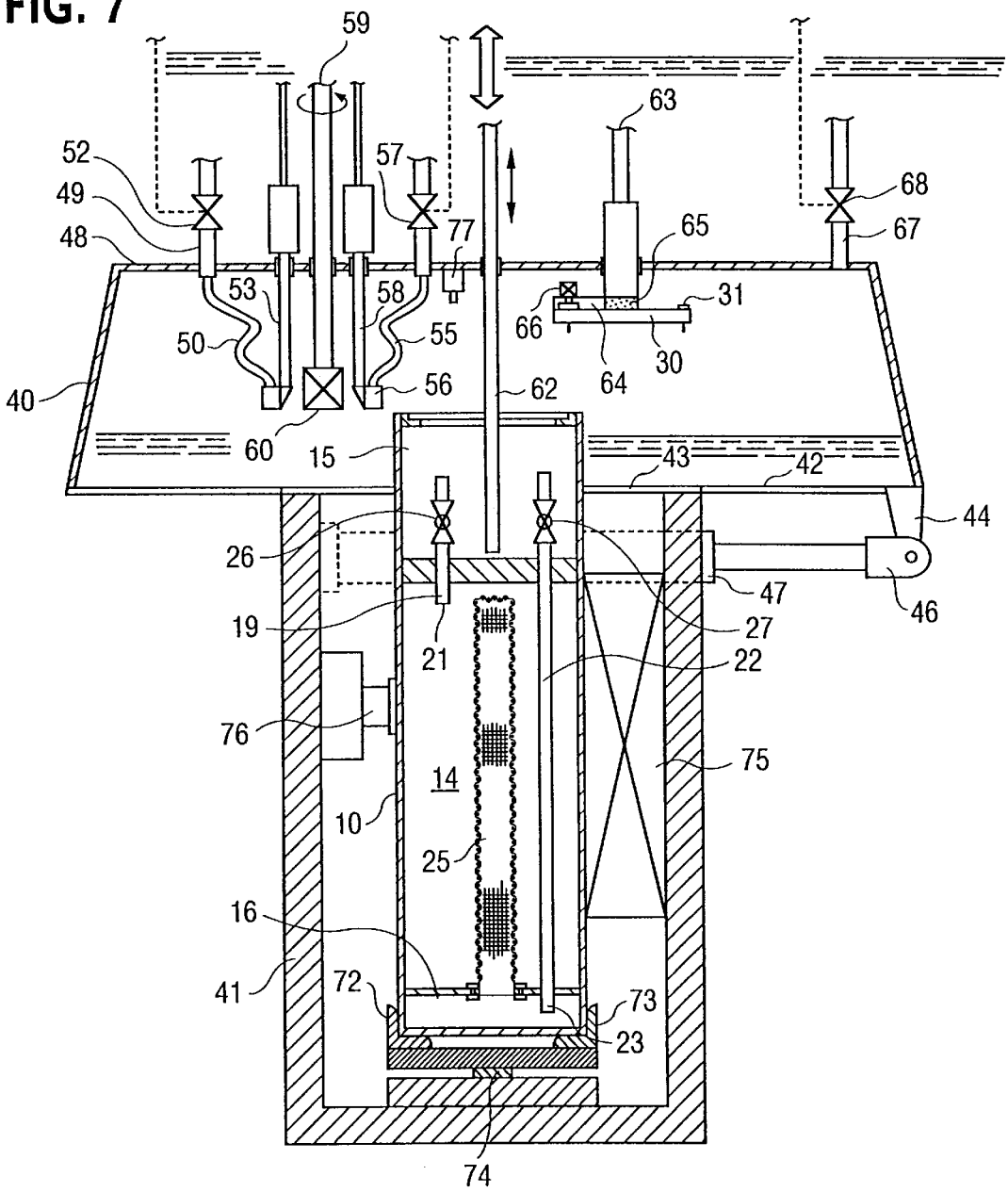
FIG. 7 is an elevation view of the system of the present invention showing the hood in a second intermediate position relative to the support structure for suctioning water out of the upper volume of the container.
Figure 8:
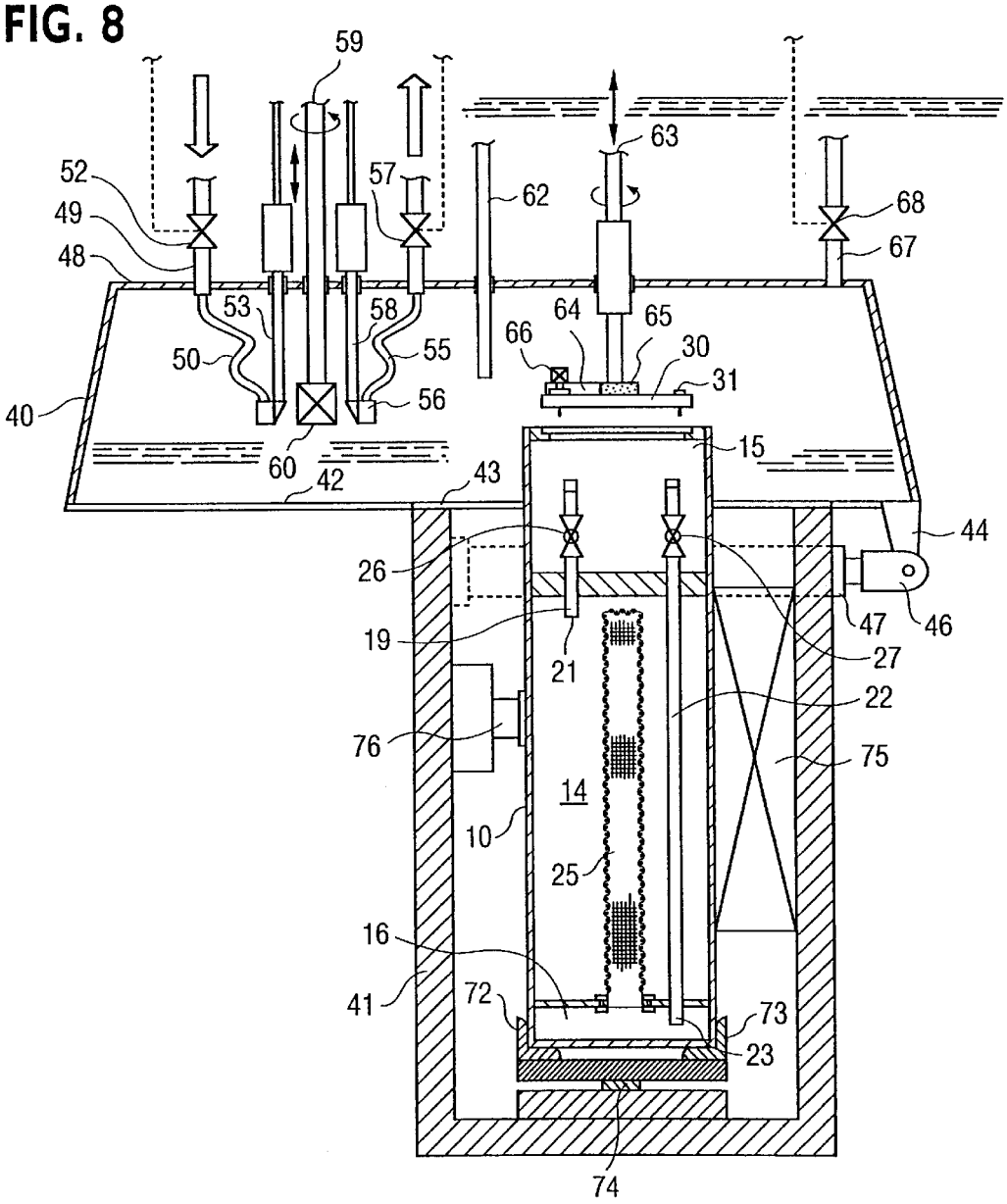
FIG. 8 is an elevation view of the system of the present invention showing the hood in a third sealing position relative to the support structure for securing a closure cover to the container.

The operation of the system according to the present invention will now be described with reference to FIGS. 6 to 8 of the drawings.

Figure 6:
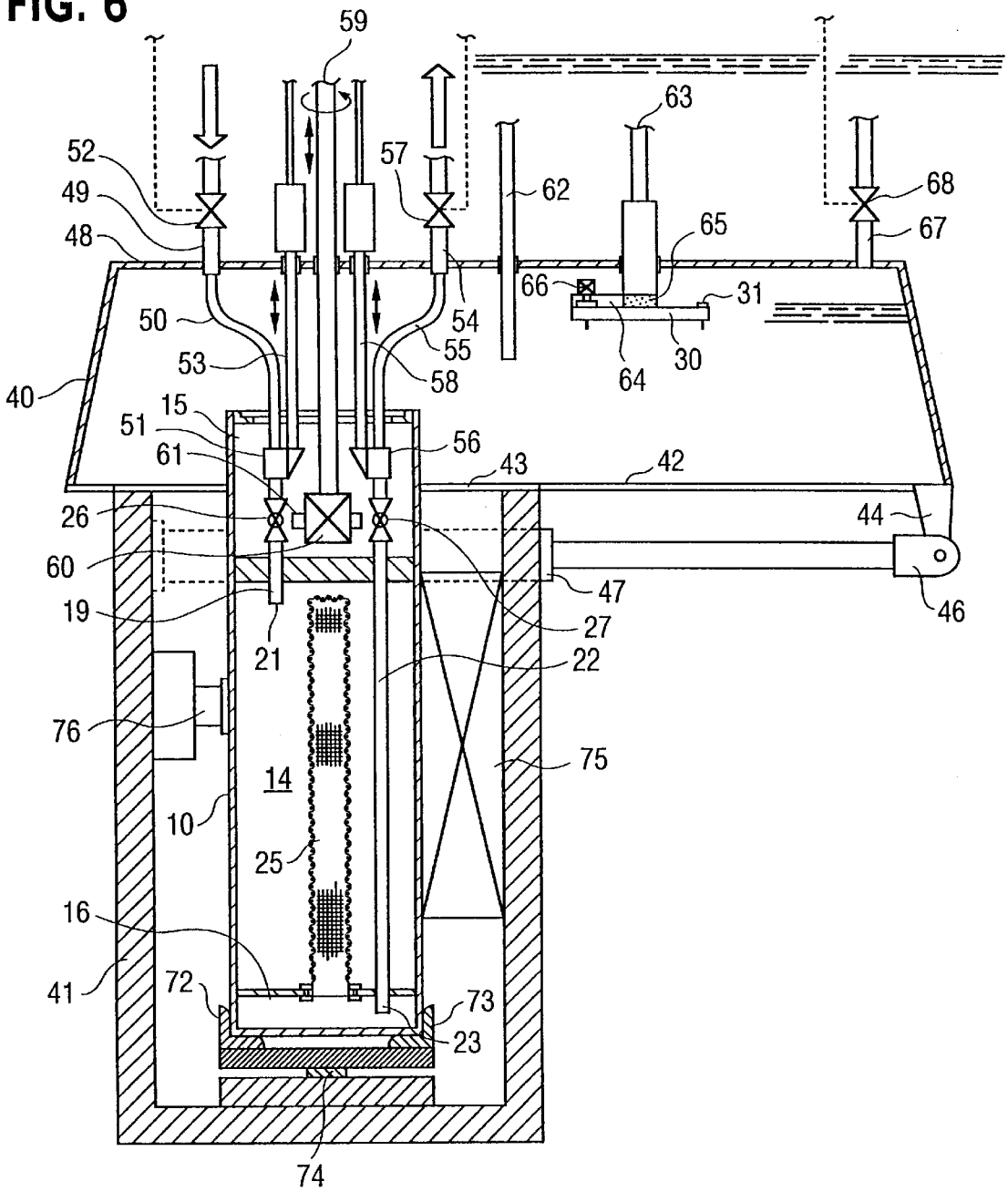
FIG. 6 is an elevation view of the system of the present invention showing the hood in a first filling/dewatering position relative to the support structure for filling, dewatering, and isolating the container.

As shown in FIG. 6, the container 10 is placed within the support structure 41 and held beneath the hood 40 in a first filling/dewatering position. The entire assembly is positioned beneath the surface of a water volume at a depth sufficient to shield operating personnel from exposure to radioactive waste being loaded into the container 10.

The pole operators 53, 58 are lowered into the secondary volume 15 of the container 10 to cause the flexible fill and dewatering lines 50, 55 to be connected to the corresponding ends 20, 24 of the fill and dewatering tubes 19, 22 on the container 10. The valve operator 59 is also lowered into the secondary volume 15 of the container 10 to a position between the isolation ball valves 26, 27 on the container 10. In this position, the interfacing structure 61 on the valve operator 59 is operable to engage and selectively open or close the isolation ball valves 26, 27 on the container 10.

With the valves 26, 52 on the fill tube 19 and fill line 49 open, a slurry containing radioactive debris is injected through the fill tube 19 into the primary volume 14 of the container 10. The amount of debris within the container 10 is monitored by the scale 74 positioned beneath the container 10. As the container 10 is being filled, the valves 27, 57 on the dewatering tube 22 and dewatering line 54 are opened and water is suctioned out from the water collection chamber 16 of the container 10 through the dewatering tube 22. A vacuum pump is connected to the dewatering line 54 to aid in the dewatering operation. The vibrator 75 is also operated during the dewatering process to cause the debris in the container 10 to settle and cause water to flow out through the dewatering filter 25. A final step of filling may include an injection and subsequent dewatering of a chemistry that chemically stabilizes the radioactive debris.

After the primary volume 14 of the container 10 is filled and dewatered, the isolation ball valves 26, 27 are closed using the valve operator 59, the valves 52, 57 in the fill and dewatering lines 49, 54 are closed, the connectors 51, 56 of the fill and dewatering lines 49, 54 are disconnected from the container 10, and the pole operators 53, 58 and valve operator 59 are raised out of the secondary volume 15 to a position above the container 10. The hood 40 is then moved to its second position relative to the support structure 41, as shown in FIG. 7.

In the second intermediate position of the hood 40, a gas, such as air or nitrogen, is introduced into the hood 40 through the straw 62 until the water level 76 under the hood 40 is displaced to a level below the top of the container 10. The straw 62 is then lowered into the secondary volume 15 of the container 10 and used to suction out the water from the secondary volume 15. A camera 77 can be mounted to the upper wall 78 of the hood 40 to confirm that this operation is completed. Also, a dye can be injected through the straw 62 or another line provided for this purpose into the secondary volume 15 to facilitate visual monitoring of the fluid in the secondary volume 15 with the camera 77.

After the water is suctioned out of the secondary volume 15, the straw 62 is raised out of the secondary volume 15 to a position above the container 10. The hood 40 is then moved to its third position relative to the support structure 41, as shown in FIG. 8.

In the third sealing position, the closure operator 63 lowers and manipulates the cover 30 into position on the container 10. Once the cover 30 is positioned properly, the tightening means 66 rotates and tightens the fastening bolts 31 to secure the cover 30 to the container 10. The closure operator 63 is then raised above the container 10 to complete the operation. At this point, the container 10 is filled, dewatered, sealed and ready for transport and storage.

The system described above provides several advantages over existing technology. For example, the system provides a procedure for controlled and remote handling, filling, dewatering, and sealing of high integrity containers 10 for storing radioactive debris, while minimizing exposure to operating personnel. The vibrating source in contact with the container 10 within the support structure 41 facilitates a flow of water through the internal dewatering filter 25 during the dewatering process. The isolation of the fill and dewatering lines 49, 54 minimizes release of particulate during connector mating and demating operations.

It will be appreciated that the present invention is not limited to the exact constructions that have been described above and illustrated in the accompanying drawings, and that various modifications and changes can be made without departing from the scope and spirit of the invention. It is intended that the scope of the invention only be limited by the appended claims.

What is claimed is:

1. A method of filling and sealing a container with radioactive debris, comprising the steps of:

placing a container within a support structure submerged in water and covering the support structure and container with a hood submerged in the water; and, while the hood remains submerged in water, then:

lowering a connector portion of a fill line into a secondary volume of the container and connecting the connector portion of the fill line to a fill tube of the container;

lowering a connector portion of a dewatering line into the secondary volume of the container and connecting the connector portion of the dewatering line to a dewatering tube of the container;

injecting a slurry of radioactive debris into a primary volume of the container through the fill line and fill tube; and removing fluid from a slurry of radioactive debris within the container through the dewatering tube and dewatering line.

2. The method of claim 1, further comprising the steps of:

isolating the fill line and fill tube using a first pair of valve assemblies;

isolating the dewatering line and dewatering tube using a second pair of valve assemblies; and raising the respective connector portions of the fill line and dewatering line out of the secondary volume of the container.

3. A The method of claim 2, further comprising the steps of:

moving the hood relative to the support structure and container into an intermediate position;

introducing a gas into the hood to displace a water within the hood to a level below an upper end of the container;

lowering a straw into the secondary volume of the container and removing water from the secondary volume through the straw; and raising the straw out of the secondary volume.

4. The method of claim 3, further comprising the steps of:

injecting a dye into the secondary volume after the water within the hood is displaced to a level below the upper end of the container; and visually checking a water level in the secondary volume using a camera.

5. The method of claim 2, further comprising the steps of:

moving the hood relative to the support structure and container into a sealing position;

lowering a cover into sealing engagement with the container; and securing the cover to the container.

6. The method of claim 1, further comprising the step of vibrating the container to facilitate removal of water from the slurry of radioactive debris.

7. The method of claim 1, further comprising the step of monitoring an amount of radioactive debris within the container using a scale positioned between the support structure and the container.

* * * * *